US007044216B2

(12) United States Patent
Otten et al.

(10) Patent No.: US 7,044,216 B2
(45) Date of Patent: May 16, 2006

(54) LARGE DIAMETER FLUSH-JOINT PIPE HANDLING SYSTEM

(75) Inventors: Gregory K. Otten, Houston, TX (US); James Light, Katy, TX (US); Chad Van Liere, Houston, TX (US)

(73) Assignee: Grant Prideco, L.P., Houston, TX (US)

( * ) Notice: Subject to any disclaimer, the term of this patent is extended or adjusted under 35 U.S.C. 154(b) by 233 days.

(21) Appl. No.: 10/605,910

(22) Filed: Nov. 5, 2003

(65) Prior Publication Data

US 2005/0092500 A1 May 5, 2005

(51) Int. Cl.
*E21B 19/06* (2006.01)
*B68C 1/66* (2006.01)

(52) U.S. Cl. ..... 166/77.52; 166/75.14; 294/90

(58) Field of Classification Search ..... 166/75.14, 166/77.52; 294/90
See application file for complete search history.

(56) References Cited

U.S. PATENT DOCUMENTS

| | | | | | |
|---|---|---|---|---|---|
| 1,646,981 | A | | 10/1927 | Rick | |
| 2,719,025 | A | | 9/1955 | Stone | |
| 3,063,509 | A | * | 11/1962 | Guier | 175/85 |
| 3,094,852 | A | * | 6/1963 | Taylor | 464/183 |
| 3,308,970 | A | * | 3/1967 | Wilson et al. | 414/22.51 |
| RE29,995 | E | * | 5/1979 | Guier | 294/90 |
| 4,209,066 | A | | 6/1980 | Watson | |
| 4,417,846 | A | * | 11/1983 | Elliston | 414/745.2 |
| 4,834,441 | A | * | 5/1989 | Schivley | 294/90 |
| 5,609,226 | A | * | 3/1997 | Penisson | 188/67 |
| 6,070,912 | A | * | 6/2000 | Latham | 285/61 |
| 6,237,684 | B1 | * | 5/2001 | Bouligny et al. | 166/77.52 |
| 6,349,764 | B1 | * | 2/2002 | Adams et al. | 166/77.53 |
| 6,361,251 | B1 | * | 3/2002 | Soltanahmadi et al. | 405/170 |
| 6,378,614 | B1 | * | 4/2002 | Adams et al. | 166/382 |
| 6,494,273 | B1 | * | 12/2002 | Martin | 175/220 |
| 6,536,541 | B1 | * | 3/2003 | Pedrelli | 175/135 |
| 6,644,413 | B1 | * | 11/2003 | Adams et al. | 166/382 |

OTHER PUBLICATIONS

International Search Report Summary for PCT/GB03/04800; application filed Nov. 6, 2003.

* cited by examiner

*Primary Examiner*—Jennifer H. Gay
*Assistant Examiner*—Shane Bomar
(74) *Attorney, Agent, or Firm*—Jeffery E. Daly; Williams, Morgan & Amerson

(57) ABSTRACT

An elevator for assembling a plurality of a large diameter pipe joints into a pipe string with a drilling rig is disclosed. The first one of a number of large diameter pipe joints is adapted to threadingly engage another large diameter pipe joint. The elevator is detachably securable to the upper end of the first joint, and is adapted to both lift and position the first joint while it is stabbed and tightened onto the string. The elevator is further adapted to co-operatively engage the rotary table of the drilling rig to rotatably tighten the second joint to the first joint as the second joint is added to the string.

16 Claims, 12 Drawing Sheets

LOWER TO ROTARY AND TIE OFF

LOWER TO ROTARY
AND TIE OFF

MAKE CONNECTION
AND REMOVE LOWER LUG

LOWER TO ROTARY

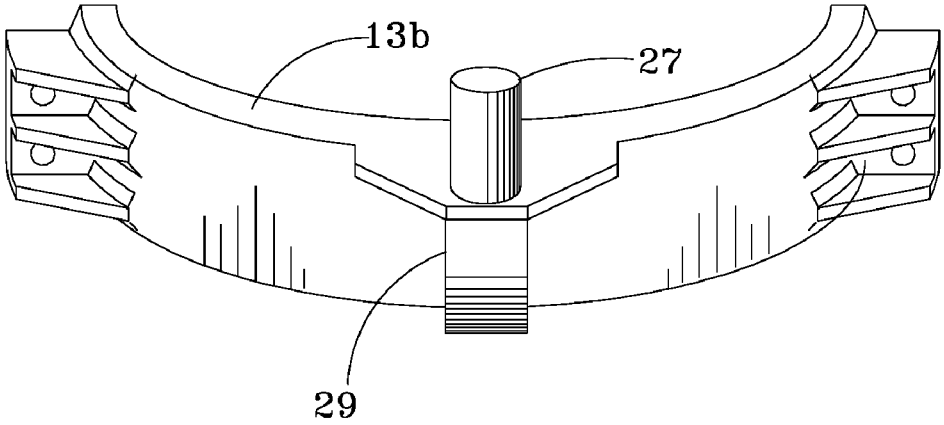
FIG.8
FIG.9
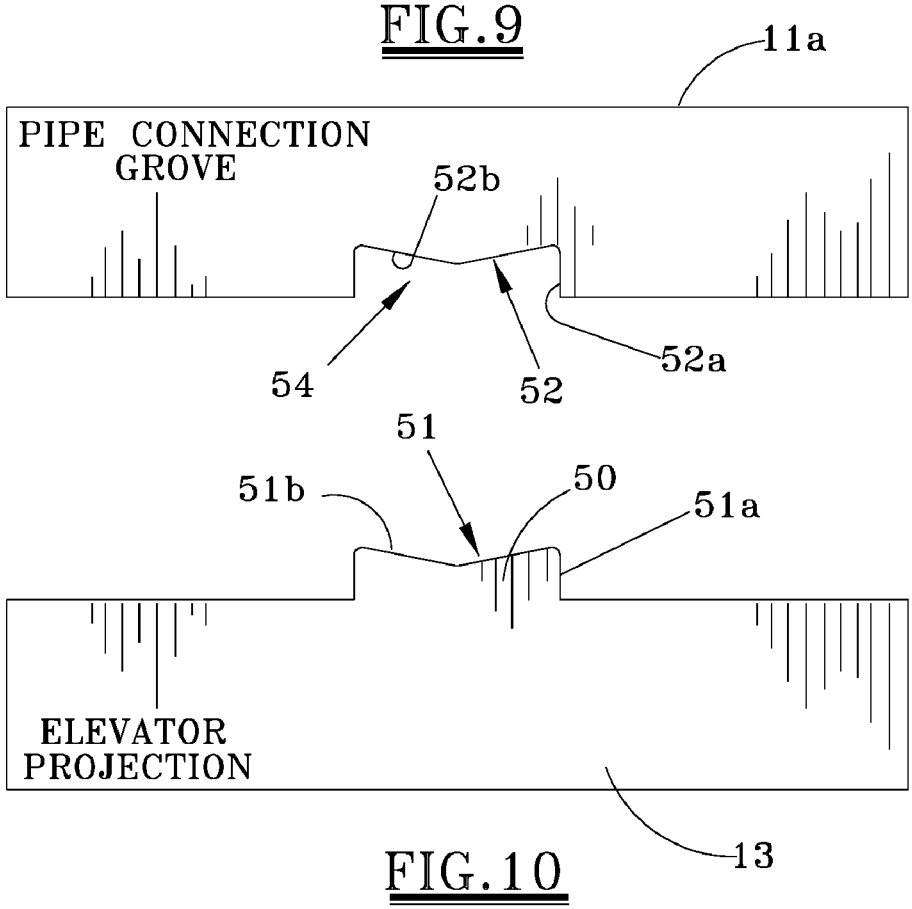
FIG.10

FIG. 11
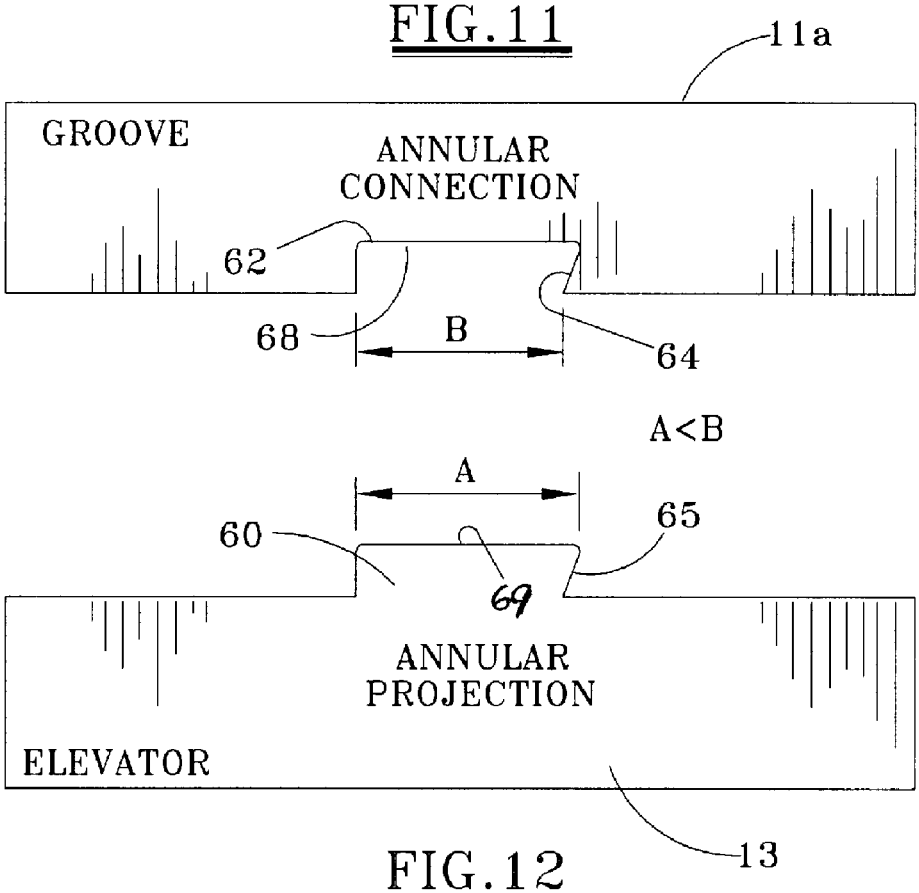
FIG. 12
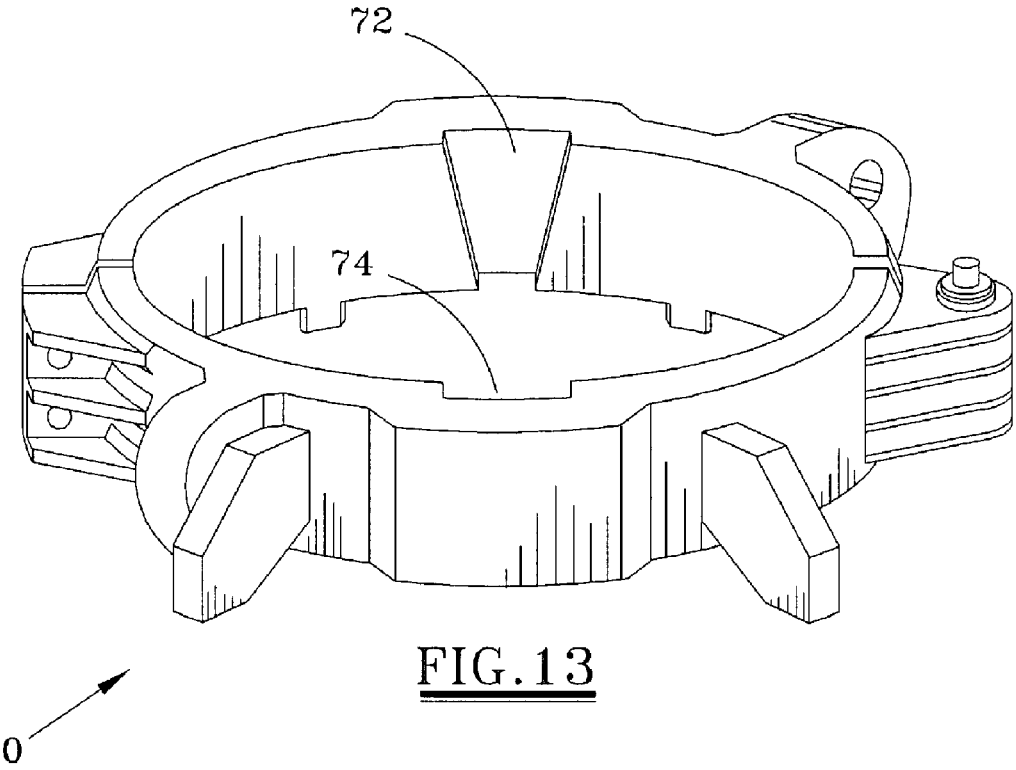
FIG. 13

LARGE DIAMETER FLUSH-JOINT PIPE HANDLING SYSTEM

BACKGROUND OF INVENTION

Flush joint (or "near flush joint") pipe used for riser pipe in offshore drilling and/or used for conductor pipe for deep well drilling is often too large in diameter to be handled by conventional die-grip casing handling tools. The most commonly available die-grip tools for handling large pipe have a maximum diameter capacity of approximately 24 in. Riser pipe and conductor pipe can have a substantially larger diameter, frequently in excess of 36 in.

The present invention relates to special equipment and procedures for handling and running large diameter flush-joint pipe in offshore wells and/or other drilling sites requiring pipe having diameters exceeding the capacity of conventional running tools.

SUMMARY OF INVENTION

In one embodiment, an elevator for assembling a plurality of a large diameter pipe joints into a pipe string with a drilling rig is disclosed. A first one of the plurality of large diameter pipe joints is adapted to threadingly engage a second one of the plurality of large diameter pipe joints. The elevator is detachably securable to an upper end of the first joint and adapted to both lift and position the first joint while it is stabbed and tightened onto the string. After stabbing and tightening, the elevator is lowered with the joint where it is further adapted to co-operatively engage the rotary table of the drilling rig to rotatably tighten the second joint to the first joint as the second joint is added to the string.

Also disclosed is an elevator clamped to the joint with a bolt on collar, or it may be bolted around an annular groove formed in an external surface of the pipe joint. The collar may have a plurality of Keystone-shaped recesses that extend over corresponding keystone shaped projections attached to the external surface of a pipe joint. In addition the groove in the joint may frictionally engage a complimentary, annular, centrally extending projection developed along an inner circumferential surface of the collar. Also disclosed is the groove in the joint with a reverse angle shoulder adapted to engage and rest upon a similarly angled projection in the collar.

As the collar supports a weight of the string from the rotary table, a surface of the projection in the collar may be slightly spaced axially from a groove surface in the joint whereby the surface of the projection engaging the groove surface supports a substantial amount of the vertical load imparted to the collar by the weight of the string.

In addition, the elevator may have a plurality of lifting pad eyes for attachment to lift lines on the drilling rig, and rotary table lugs may extend from the lifting pad eyes to engage the rotary table.

Also disclosed is an elevator having two halves, each half comprising a plurality of bolt ears adapted to receive bolts for clamping the collar.

BRIEF DESCRIPTION OF DRAWINGS

FIGS. 6–12 are views of various arrangements of bolt on elevators (collars) of the present invention.

FIGS. 13–16 are views of an alternate embodiment of bolt on elevators (collars) of the present invention.

DETAILED DESCRIPTION

Figure 1:
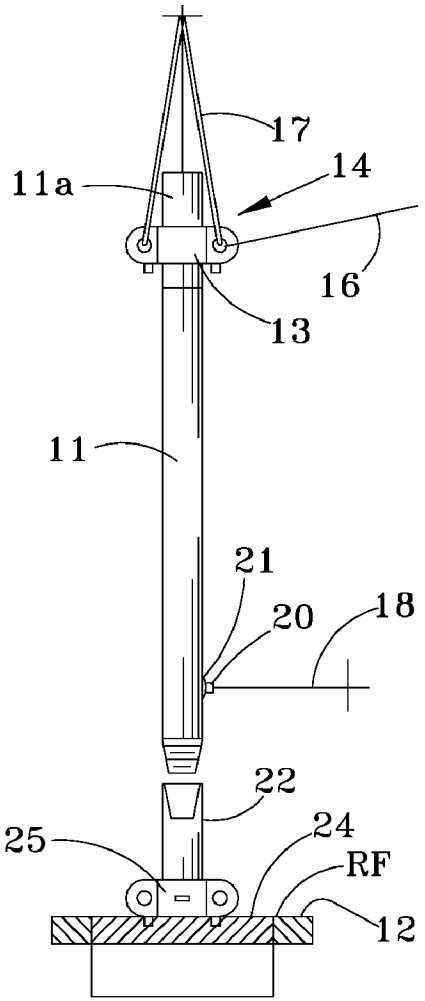
FIGS. 1–3 are general views of bolt on elevators (collars) of the present invention.
Figure 2:
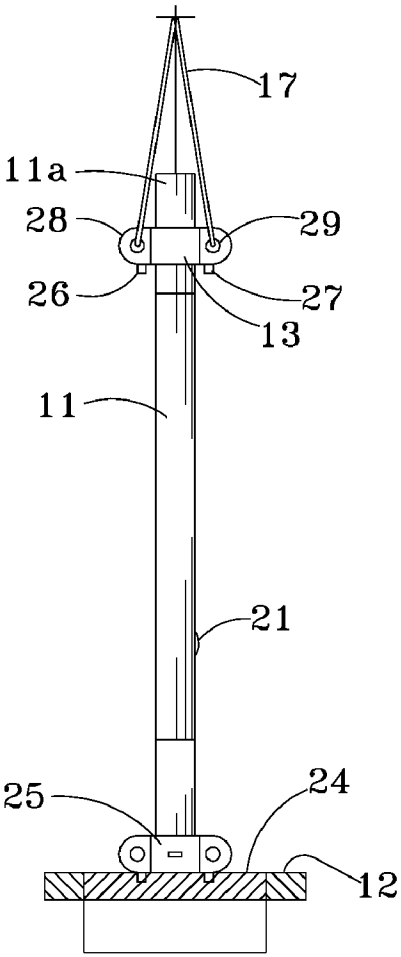
Figure 3:
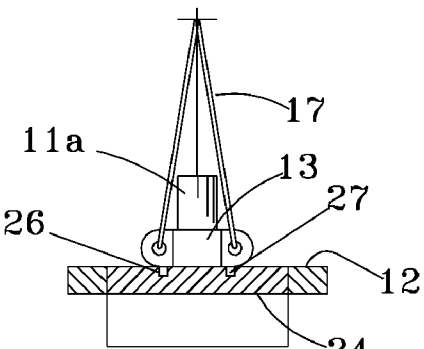

A large diameter pipe joint 11 is moved from a storage location on a drilling rig to a vertical orientation in the drilling rig derrick to be run through the drilling rig floor RF, 12 into the sea or into the well bore below the rig. The lower end of the pipe joint 11 terminates as a threaded pin and the upper end terminates as a connector 11*a* in the form of an internally threaded box. Multiple pipe joints, such as the joint 11, are assembled to form a continuous flush joint pipe string of pipe that extends from the rig and through the sea to the sea bottom or into a well bore below the rig.

In assembling the pipe string, a pipe elevator (collar) 13 is attached to the upper end area 14 of an individual joint of the pipe to assist in bringing the pipe to the vertical running position. In one form of the Invention, the elevator 13 provides one of the attachment fixtures for the lines 16 and 17 used to lift and/or move the pipe to the vertical orientation. Additional positioning and restraint lines, such as the snub line 18 are attached to a fixture 20 that is removably secured to an attachment plate 21 bonded to the pipe. Once the joint 11 is in its vertical position, the elevator 13 supports the joint 11 vertically so that it may be added to a string of the pipe 22 extending through the rotary table 24 on the drilling rig floor 12.

One embodiment of the elevator 13 is a bolt-on collar with an internal annular projection. (FIGS. 4, 6–12). The collar is bolted around an annular groove machined into the external surface of an internally threaded connector 11*a* at the top of the joint 11. The connector 11*a* may be welded onto the tubular body of the joint 11 to provide an internally threaded box connection at the upper end of the joint or it may be otherwise secured to, or formed at, the end of the tubular body. The groove is machined or otherwise suitably formed in the outer surface of the connector 11*a*. Machining is preferred to provide uniform surface contact between the elevator projection and the connector groove.

A second embodiment of the elevator is a bolt-on collar having axially extending Keystone-shaped recesses that extend over corresponding Keystone shaped projections welded to the external surface of the internally threaded connector. (FIGS. 13–16). The terms "collar" and "elevators" are used interchangeably in the description of the present invention.

An elevator 25 is connected to the top of the assembled pipe string 22 extending below the rotary table. The elevator 25 rests on the rotary table 24 to support the string 22. The elevator 25 is identical to the elevator 13 that supports the joint of pipe 11 being added to the string.

The new joint 11 being added to the string is threaded into the string 22 by rotating the suspended string 22 with the rotary table 24 while holding the new joint stationary with a snub line 18 secured to the removable handling fixture 20. The rotary 24 is rotated in a counter-clockwise direction to cause the right hand threads of the joint 11 and the string 22 to engage. The opposite end of the snub line 18 is secured to a stationary point (not illustrated) on the rig.

Once the joint 11 is properly engaged to the string 22, the lift lines 17 extending between the uppermost collar 13 and the top drive or traveling block of the rig (not illustrated) are raised to lift the joint 11 and attached string 22. Lifting the string 22 permits the lower collar 25 to be removed from the string. Once the collar is removed, the string 22, including the newly added joint 11, is then lowered until the upper collar 13 is resting on the rotary table 24 where it may support the entire string full. The process is repeated until the full string of pipe is run into the well.

Figure 4:
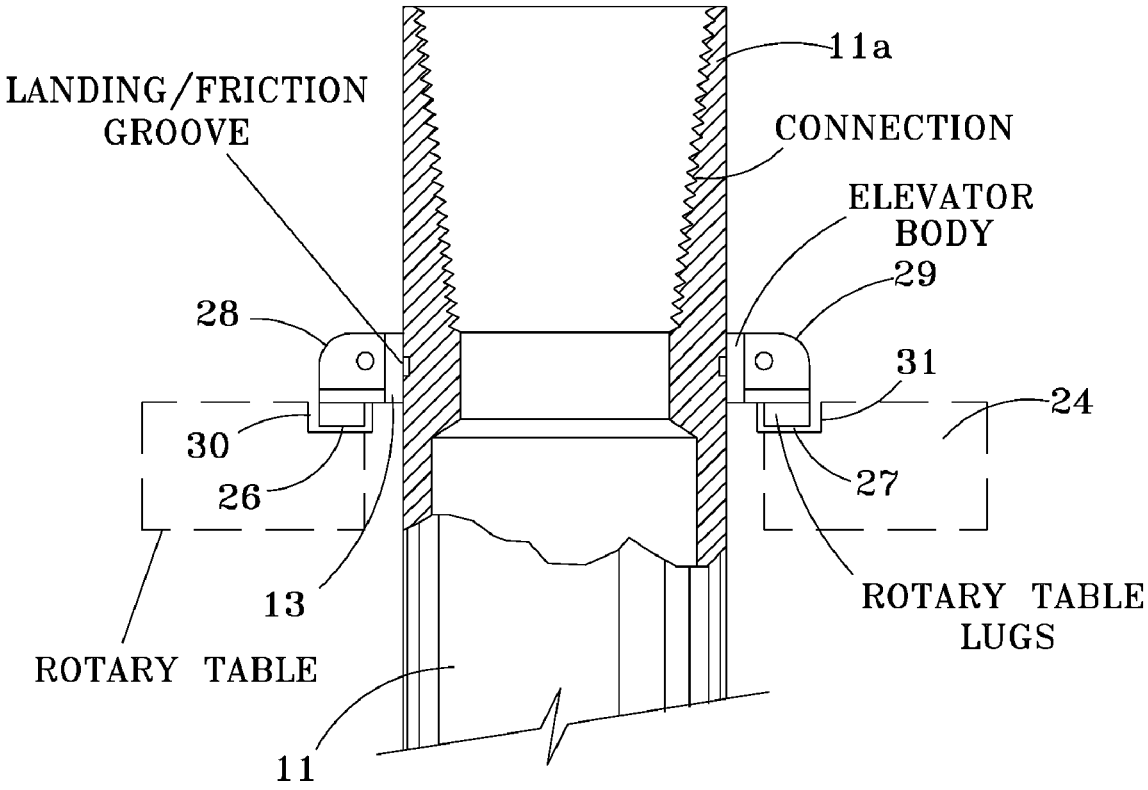
FIG. 4 illustrates cylindrical rotary table of FIGS. 1–3.

FIG. 4 illustrates cylindrical rotary table lugs 26 and 27 that extend downwardly from lifting pad eyes 28 and 29, respectively, of the elevator 13. The cylindrical rotary table lugs 26 and 27 are received in openings 30 and 31 respectively formed in the top surface of the rotary table 24. The engagement of the lugs 26 and 27 in the openings 30 and 31 transmits the rotary motion of the rotary table 24 to the collar 13, which in turn transmits the rotation to the connector 11*a* at the top of the joint 11.

Figure 5:
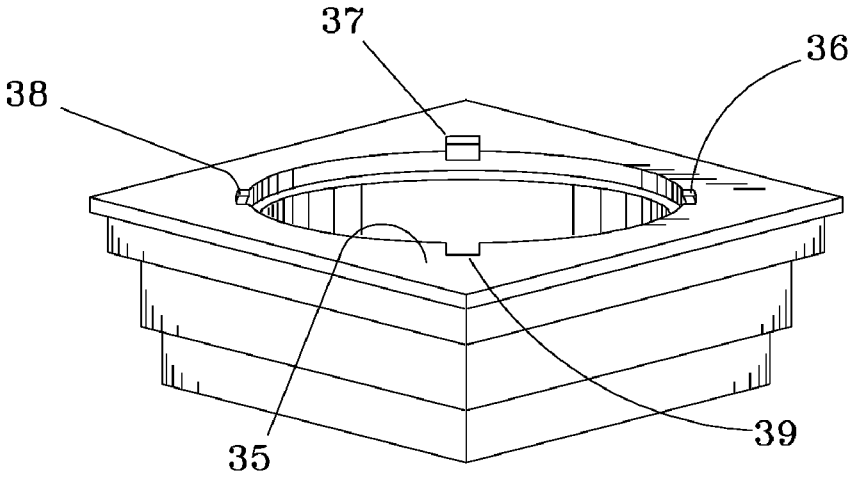
FIG. 5 illustrates a rotary support table having openings of the type used in the present invention.

FIG. 5 illustrates a conventional rotary support table 35 having openings 36–39 of the type used to receive the rotary table lugs extending from the elevator 13.

Figure 6:
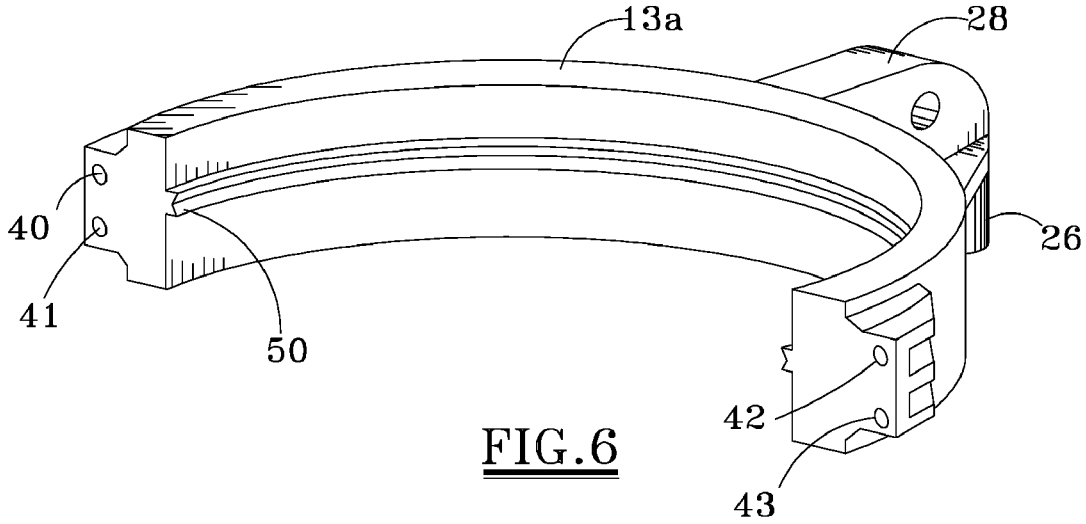
Figure 7:
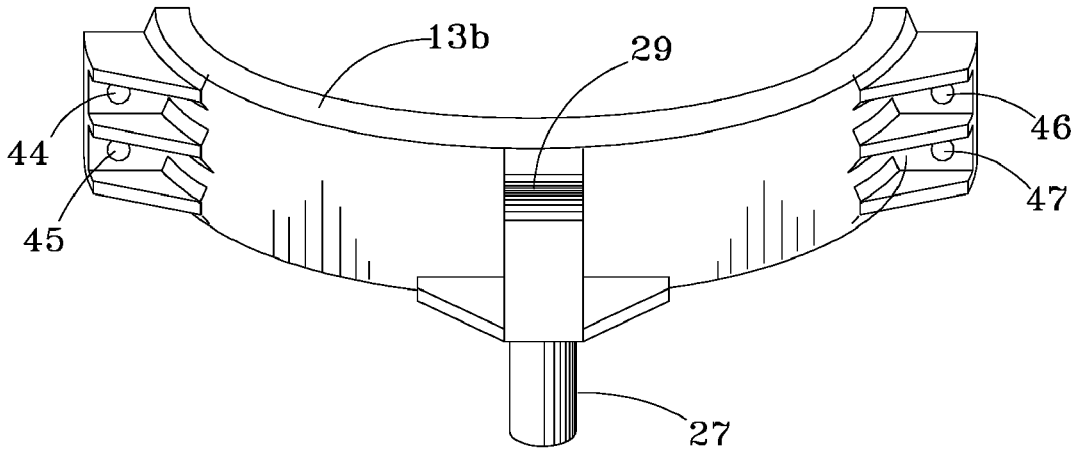
Figure 14:
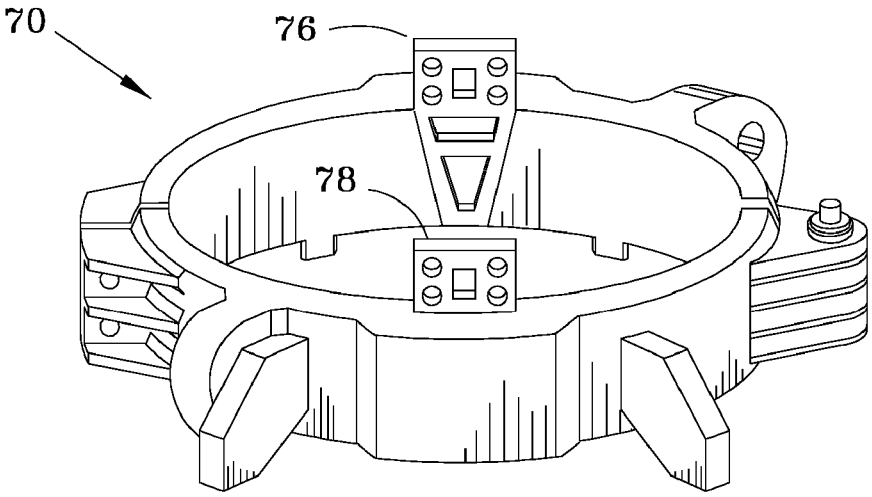

FIGS. 6 and 7 illustrate, in perspective view, two halves 13*a* and 13*b* of the elevator 13. Bolt holes 40–47 are provided in bolt ears extending radially from the two elevator halves for receiving bolts (not illustrated) used to securely clamp the elevator halves 13*a* and 13*b* about a pipe connection such as the connector 11*a*. The rotary table lug 26 extends axially away from the elevator half 13*a* while the rotary table lug 27 extends axially from the collar half 13*b*.

FIG. 8 illustrates the rotary lug 27 projecting from the bottom surface of the collar half 13*b*.

As illustrated by joint reference to FIGS. 4, 9 and 11, when the pipe connector 11*a* of the joint 11 is engaged by the collar 13, the pipe joint 11 is supported by an annular, centrally extending projection 50 developed along the inner circumferential surface of the clamp 13*a* and 13*b* of the collar 13. The external circumferential bearing surface 51 of the projection 50 conforms to the internal circumferential bearing surface 52 formed within an annular recess 54 formed about the external surface of the connector 11*a*. The cross-section of the connector 11*a* and the cross section of the projection 50 extending from the elevator 13 have conforming profiles.

With the collar securely bolted about the pipe connector 11*a*, the elevator projection surface 51 engages the groove surface 52 to effect a large radially directed gripping force against the connector 11*a*. The gripping force works with the surface friction between the two contacting surfaces to prevent relative rotation between the elevator and the connector during the process of adding joints to the string.

In a preferred embodiment of the Invention, illustrated in FIGS. 9 and 10, with the collar 13 securely clamped about the connector 11*a* and supporting the weight of the pipe string 22 from the rotary table, the projection surface 51 is slightly spaced axially from the groove surface 52*a*. The result is that the projection surface 51*b* engaging the groove surface 52*b* supports a substantial amount of the vertical load imparted to the collar by the weight of the string 22.

A modified form of the invention is illustrated in FIGS. 11 and 12. A projection 60 extending from the elevator 13 is adapted to be received within an annular recess 62 formed in the external surface of the connector 11*a*. The projection 60 and recess 62 are similar to the projection and recess of FIGS. 9 and 10 with the exception of the change in dimensions and cross sectional profile of the components.

The dimension A of the projection 60 is less than the dimension B at the entry to the groove 62 so that the elevator 13 can be closed circumferentially about the connector 11*a* with the projection 60 received within the groove 62. The recess 62 has a surface 64 formed as a reverse angle shoulder adapted to engage and rest on a similarly angled surface 65 on the annular projection 60.

When the elevator 13 is gripped around the connector 11*a*, circumferential surfaces 68 on the connector 11*a* and 69 on the elevator 13 are brought together with a strong radially directed bearing force exerted by the bolts holding the elevator halves together. The resulting bearing pressure and surface friction between the surfaces 68 and 69 prevent the elevator 13 from rotating relative to the connector 11*a* when the connector and its associated pipe joint 11 are being added to the pipe string 22.

The inclined angles of the contact surfaces 64 and 65 cooperate with the weight of the string 22 to pull the elevator 13 radially inwardly to enhance the circumferential gripping force exerted by the elevator against the pipe connector 11*a*. The inclined surfaces 64 and 65 also cooperate to hold the collar circumferentially about the pipe section 11*a* in the event of failure of the bolts or other parts of the elevator.

A feature of the form of the Invention Illustrated in FIGS. 11 and 12 is that the string weight pulls the elevator 13 into compression rather than forcing it into tension. Breakage or loss of the bolts holding the elevator halves together or partial breakage of parts of the elevator will not necessarily release the pipe from its support at the rotary table because of the trapping action provided through the mating inclined surfaces between the elevator projection and the connection groove.

The form of the invention illustrated in FIGS. 9–12 is a preferred design in that it requires no radial protrusions on the external surface of the pipe joints and is inexpensive to fabricate and employ. The system of FIGS. 9–12 also permits the pipe to be handled without requiring an increase in the outside diameter of the flush joint pipe.

The elevator 13 described in FIGS. 9–12 is inexpensive to fabricate and one such elevator may be attached to each joint of pipe before the pipe is delivered to the location where it is to be run into the well. This procedure allows the elevator to be secured to each pipe joint in a controlled environment, ensuring that the bolts are propery torqued up and that the collar is properly secured to the connector 11*a*. Placing the elevator on the pipe before it is delivered to the well location reduces the amount of time required to maneuver the pipe from its on-site storage location and run the pipe into the well. Personnel safety is also enhanced in that the collar application may be performed in the controlled environment of an indoor shop rather than the extreme, outside environment of an offshore drilling rig.

FIG. 13 illustrates an elevator, indicated generally at 70, similar to the elevator 13 previously described but intended to be used with pipe joints having permanent external radial protrusions adapted to be received within accommodating recesses in the elevator 70. The elevator 70 is designed for reuse at the well site. When an elevator 70 is removed from its support of the string 22, it is used to secure and remove a new joint from the storage rack and add the new joint into the string.

Figure 15:
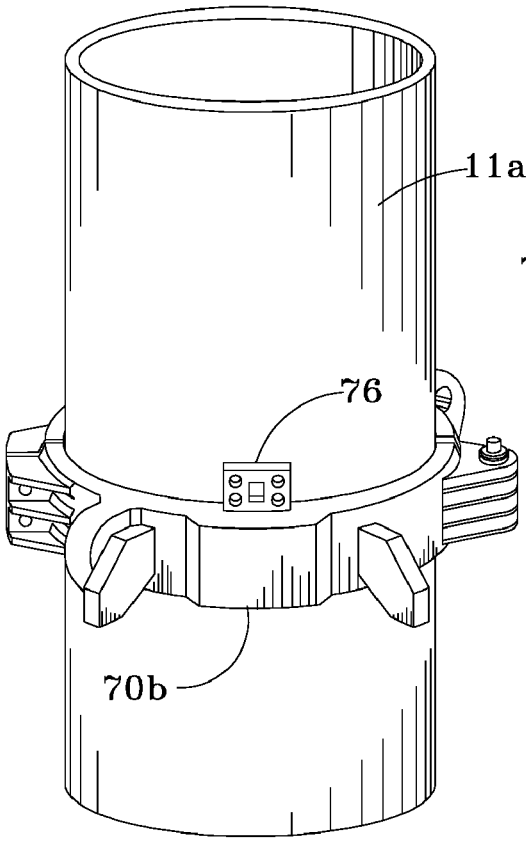
Figure 16:
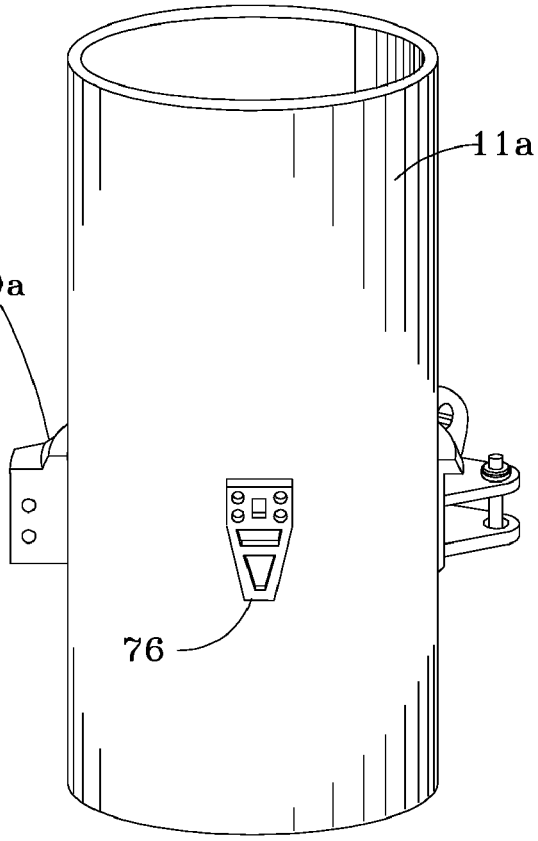

The elevator 70 is similar to the elevator 13 except that the central internal circumferential projection of the elevator 13 is replaced by Keystone shaped recesses 72 and 74 adapted to engage similarly shaped Keystone plates or projections 76 and 78 permanently secured to the external surface of the pipe section 11*a*. FIGS. 15 and 16 illustrate elevator halves 70*a* and 70*b* in position about a pipe connector 11*a* to which Keystone projections 76 and 78 have been permanently welded.

Figure 17:
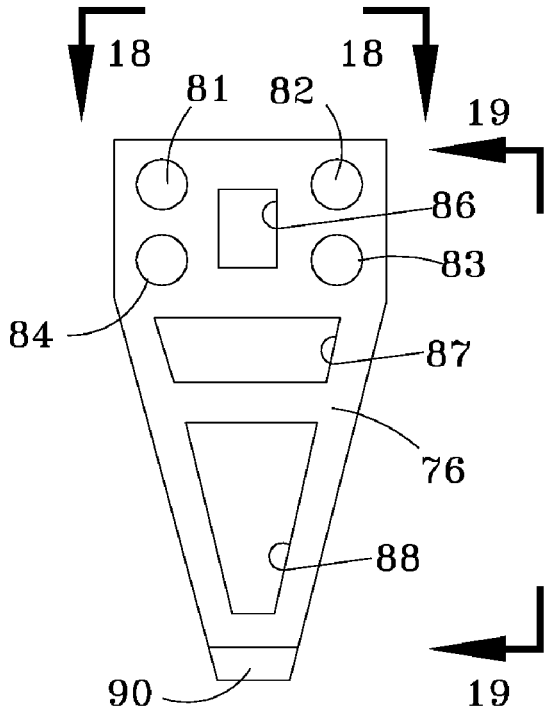
FIGS. 17–20 are views of alternate keystone plates for the collars of FIGS. 13–16.
Figure 18:
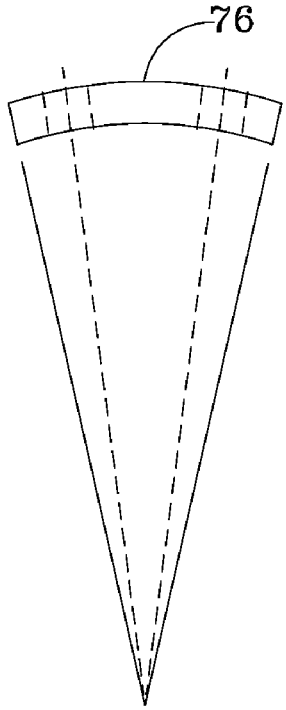
Figure 19:
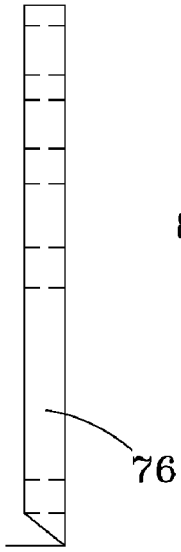
Figure 20:
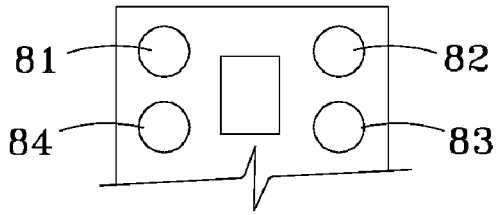

FIG. 17 is an elevation illustrating a Keystone plate that is welded to the external surface of the connector 11*a*. FIG. 18 is a top view of the Keystone plate, illustrating its arcuate shape, taken along the line 18—18 of FIG. 17. FIG. 19 is a side elevation of the Keystone plate taken along the line 19—19 of FIG. 17.

Four internally threaded bolt holes 81–84 are provided on the broad part of the Keystone plate 76. The bolt holes are used to secure handling fixtures that secure lines used in positioning and making up the pipe joints. The fixtures are removed before the joint is lowered into the well. Three weldment areas 86, 87 and 88 are provided for providing welding contact lines for welding the Keystone plate 76 to the external surface of the connector 11*a* or the pipe joint 11. The lower end of the plate 76 is tapered as indicated at 90 to reduce the probability of hanging up the pipe joint to which it is secured as the pipe joint is lowered into the well.

Figure 21:
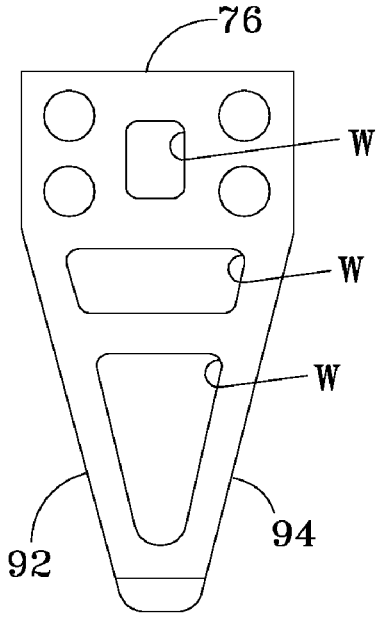
FIG. 21 is an enlarged view of the welding of the plates of FIGS. 17–20.

FIG. 21 illustrates welding W extending around the contact lines provided by the weldment areas. The welding W along the internal weldment areas secures the Keystone plate 76 to the pipe connector 11*a* without requiring placement of welding material along the external surfaces 92 and 94 of the Keystone. The external surfaces 92 and 94 are thus allowed to mate exactly with the engaging surfaces of the Keystone recesses in the elevator 70.

The provision of Keystone shapes for the elevator recesses 72 and 74 and the permanently secured pipe connector projections 76 and 78 facilitates placement of the elevator about the pipe section 11*a* and also equalizes the distribution of support forces exerted on the elevator when the elevator is holding the entire string weight.

Figure 22:
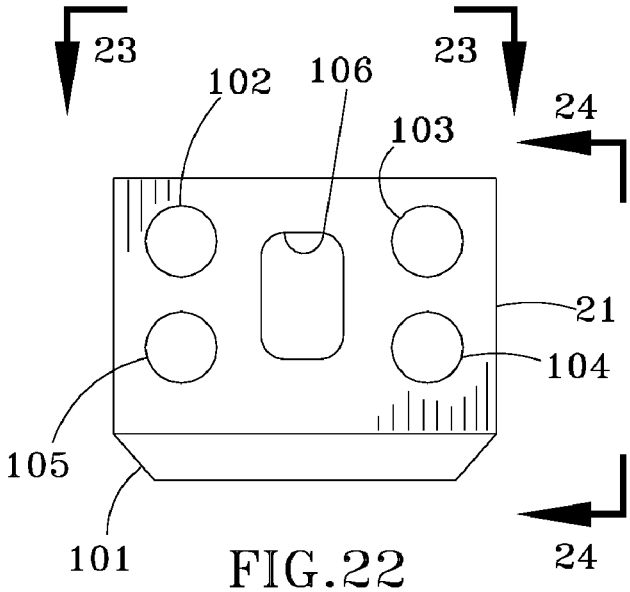
FIGS. 22–25 are views of a permanent lug plate of an alternate embodiment of the present invention.
Figure 23:
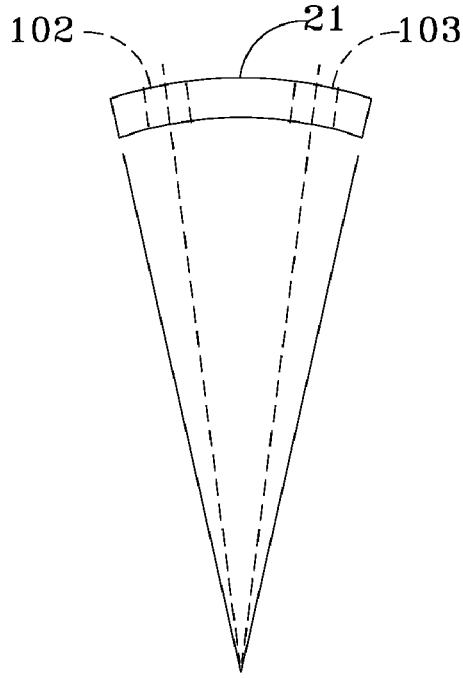
Figure 24:
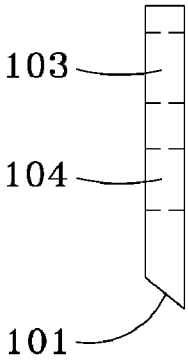
Figure 25:
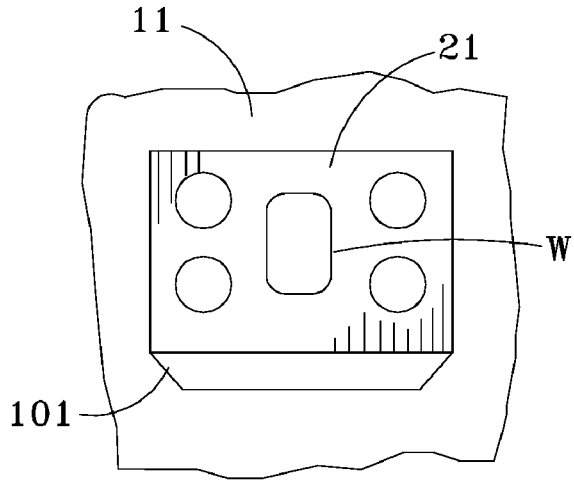

FIGS. 22–25 illustrate a permanent lug plate 21 to be welded to a pipe joint 11 to assist in handling and making up the pipe joint. FIG. 22 is a front elevation of the lug plate 21. FIG. 23 is a top view taken along the line at 23—23 of FIG. 22 illustrating the curvature of the lug plate. FIG. 24 is a side view taken along the line 24—24 of FIG. 22 illustrating the bottom taper 101 of the lug plate. FIG. 25 is a front elevation of the lug plate 21 welded onto a pipe joint 11.

The lug plate 21 is provided with four internally threaded bolt holes 102–105. A weldment area 106 cut into the lug plate 21 provides an increased welding contact line for welding the lug plate to the pipe joint 11. Welding W along the external lug edge and along the edges of the weldment area 106 is illustrated in FIG. 25 securing the lug plate 21 to a pipe joint 11.

Figure 26:
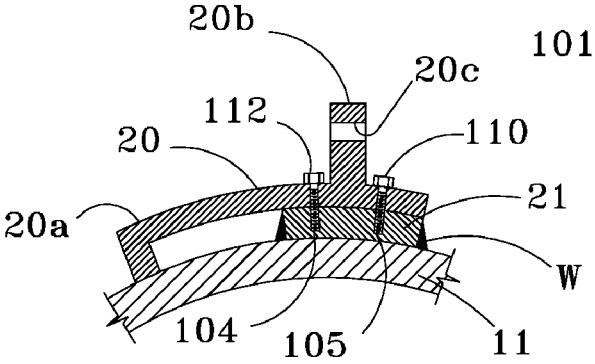
FIG. 26 is a cross section illustrating a connecting fixture secured to a lug plate in accordance with the present invention.

FIG. 26 is a cross sectional view illustrating a connecting fixture 20 secured to the lug plate 21 welded to the pipe 11. Two of four bolts 110 and 112 are illustrated seated in the bolt holes 104 and 105, respectively. The connecting fixture 20 is provided with a circumferentially extending arm 20*a* and a pad eye plate 20*b* with a pad eye opening 20*c*. The arm 20*a* assists in distributing reaction forces exerted through the restraining line 18 as the joint 11 being added to the string 22. The pad eye 20*c* provides an attachment point for the restraining and/or control line 18 used in the positioning and/or makeup of the connection.

Figure 27:
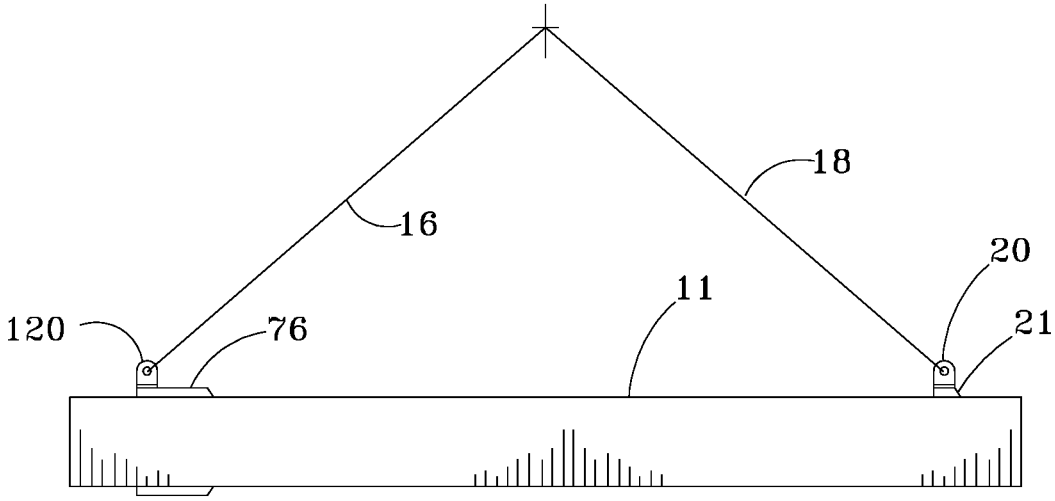
FIGS. 27–37 represent various steps in the transfer of a pipe joint of the present invention from storage to a position ready for use.

FIGS. 27 through 37 illustrate various steps in the transfer of a joint 11 from its storage location to a vertical orientation in preparation for being added to a string of pipe to be run into the well. FIG. 27 illustrates positioning lines 16 and 18 secured respectively to a connecting fixture 120 secured to a Keystone projection 76 and the connecting fixture 20. The connecting fixture 120 is similar to the connecting fixture 20 and is bolted into place in the bolt holes 81–84 of the Keystone plate. The lines 16 and 18 are illustrated lifting the joint 11 from its horizontal storage location in preparation to moving the pipe to the drilling rig floor.

Figure 28:
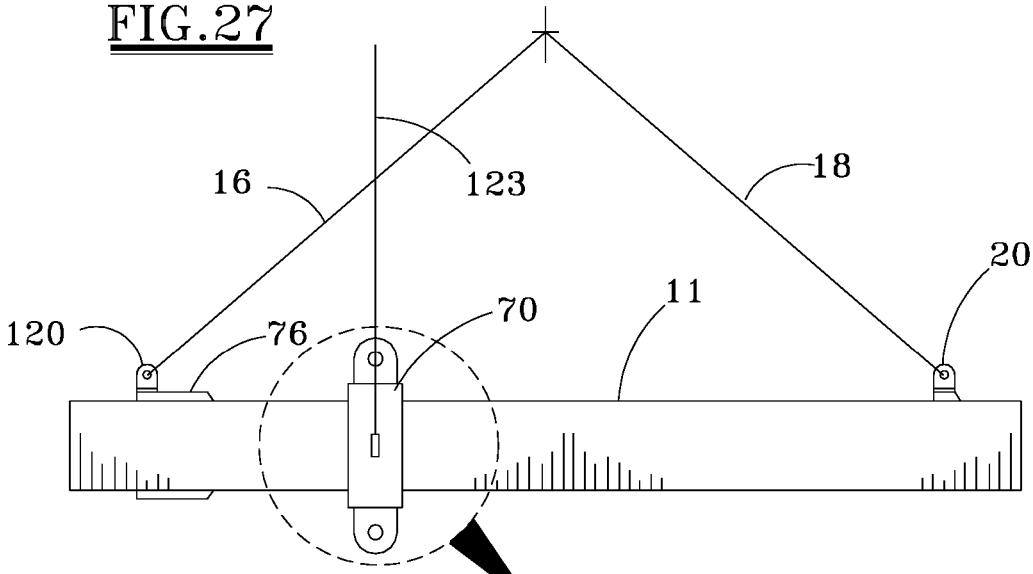
Figure 29:
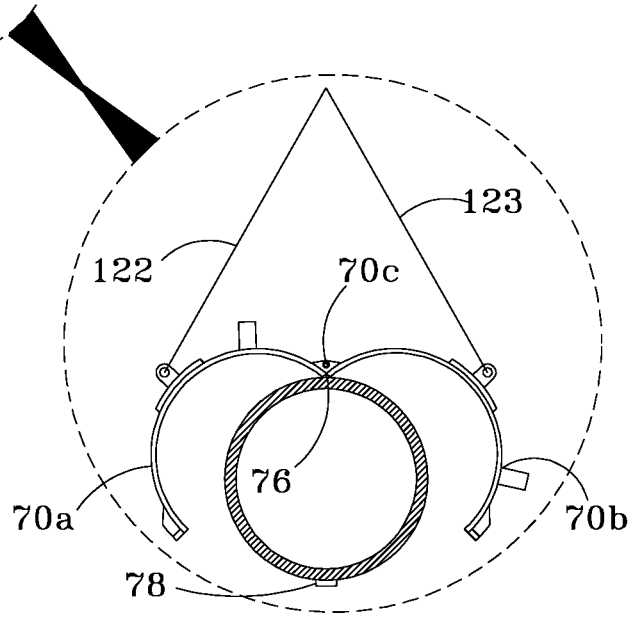

FIG. 28 illustrates the elevator 70 being positioned about the pipe 11. The elevator 70 is suspended from lines 122 and 123 respectively connected to one of the two elevator halves 70*a* and 70*b*. The lines 122 and 123 hold the elevator 70 in the open position illustrated in FIG. 29. A stop in the hinge 70*c* prevents the elevator from opening further to facilitate placement of the elevator about the pipe 11.

Figure 30:
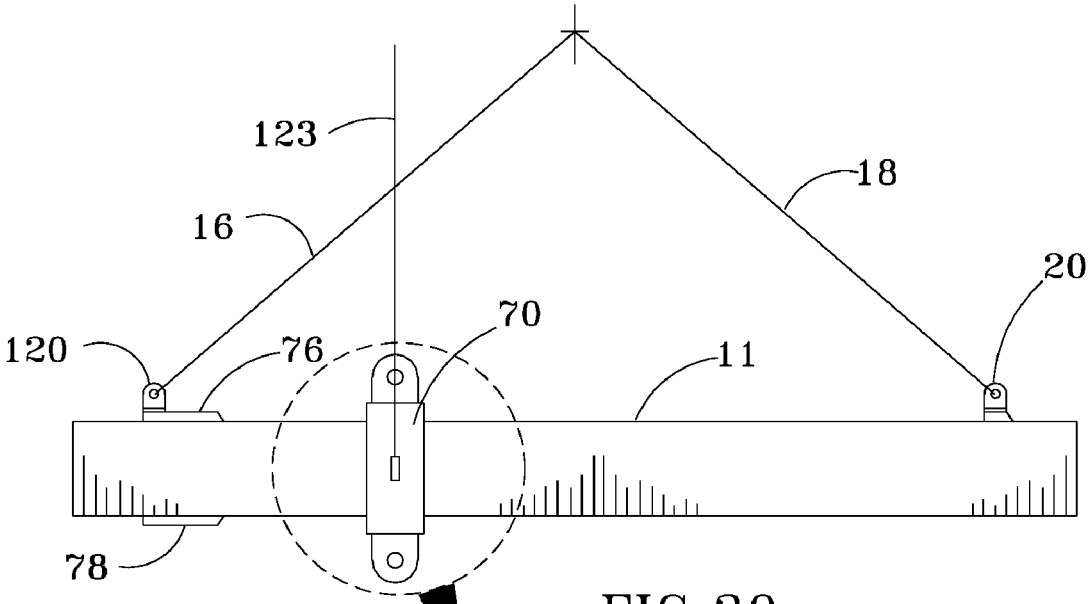
Figure 31:
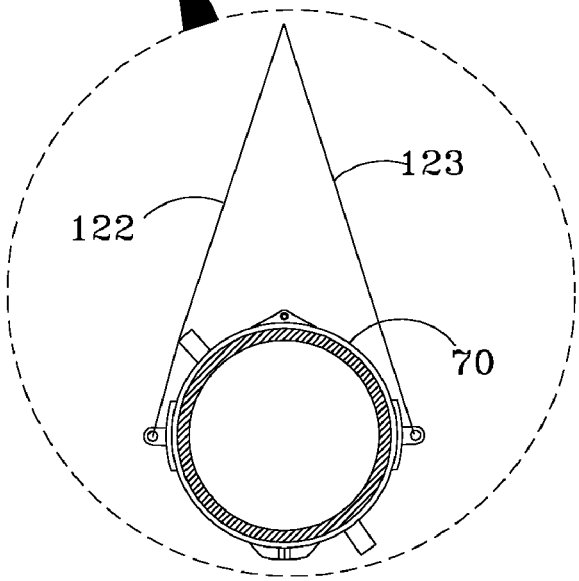
Figure 32:
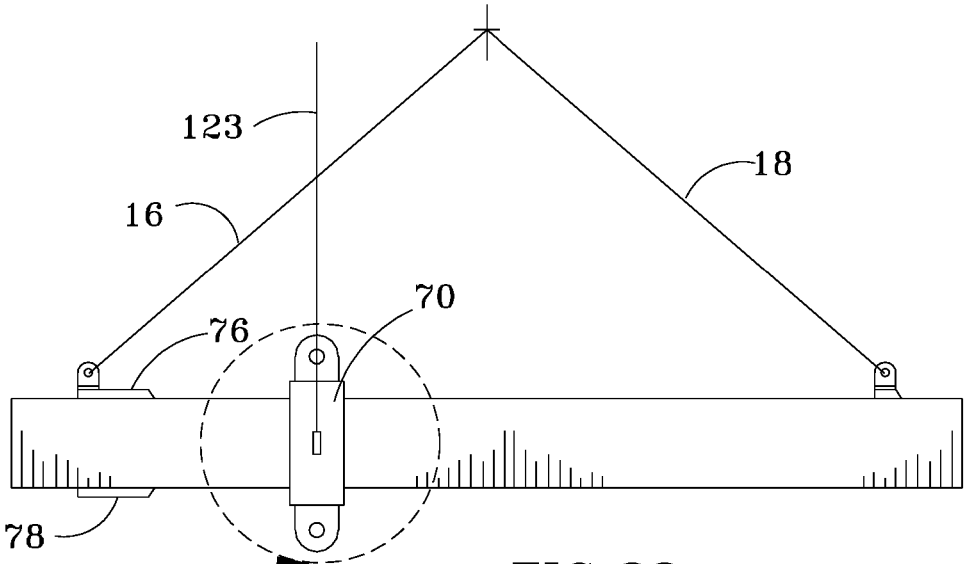
Figure 33:
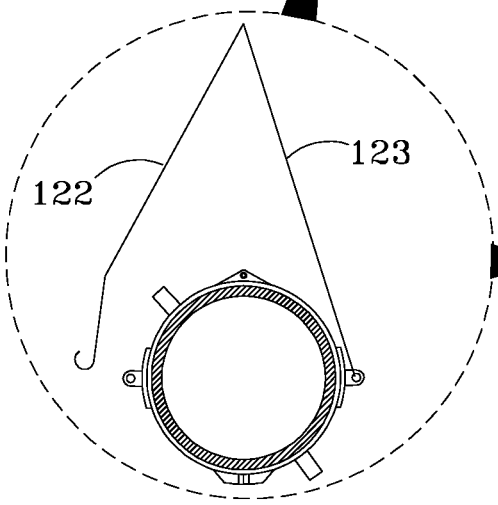
Figure 34:
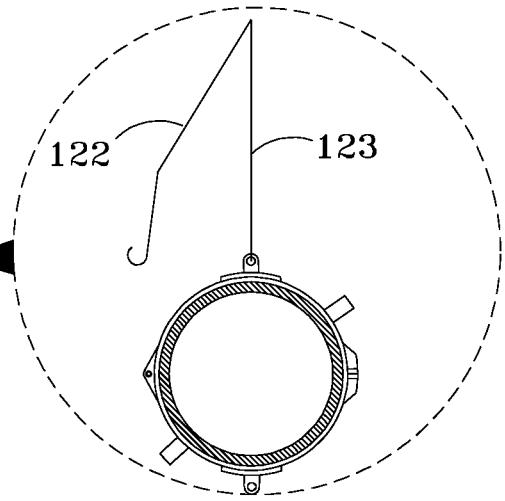

FIGS. 30 and 31 illustrate the elevator 70 loosely bolted around the pipe joint 11 prior to being moved axially into engagement with the Keystone projections 76 and 78. FIGS. 32–34 illustrate the elevator 70 being rotated around the pipe joint 11 by releasing the line 122 and raising the line 123 to align the Keystone projections on the pipe with the Keystone recesses in the elevator.

Figure 35:
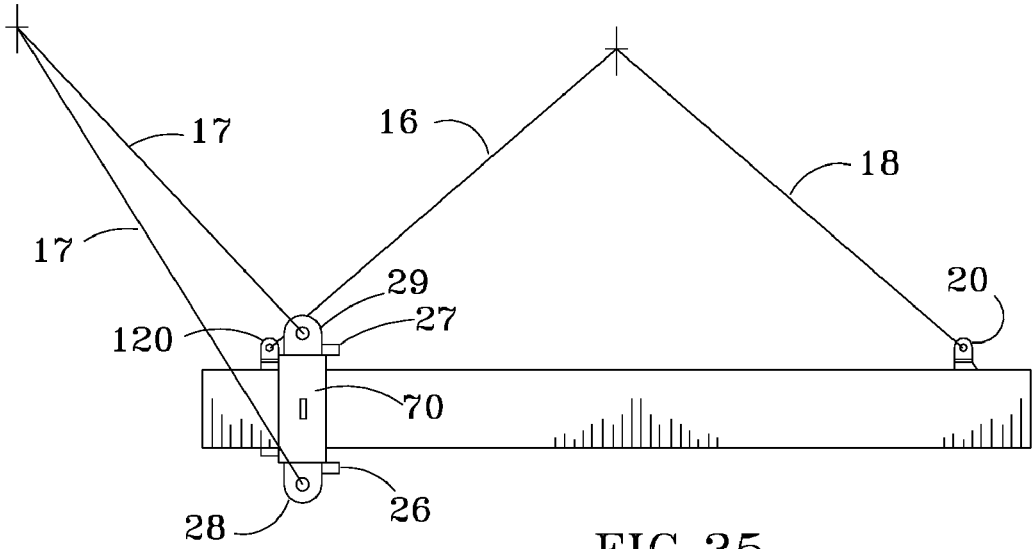

FIG. 35 illustrates the lift lines 17 being secured to the lift eyes 28 and 29 extending radially from the sides of the elevator 70. Once the lift lines 17 are properly attached to the lift eyes 28 and 29, the fixture 120 may be released from the Keystone projection 76 by removing the four bolts (not illustrated) holding the fixture to the Keystone projection. Once the joint 11 has been added to the string, the fixture 20 may be removed from the attachment pad 21. The provision of removable handling fixtures 120 and 20 on the Keystone plate and on the pipe body, respectively, provides safe and secure attachment points for moving and making up the connection and also permits the rapid removal of the fixtures to reduce the outside dimensions of the pipe joint for facilitating its introduction into the well.

Figure 37:
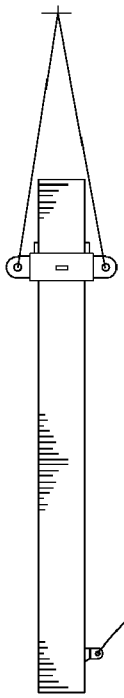
Figure 36:
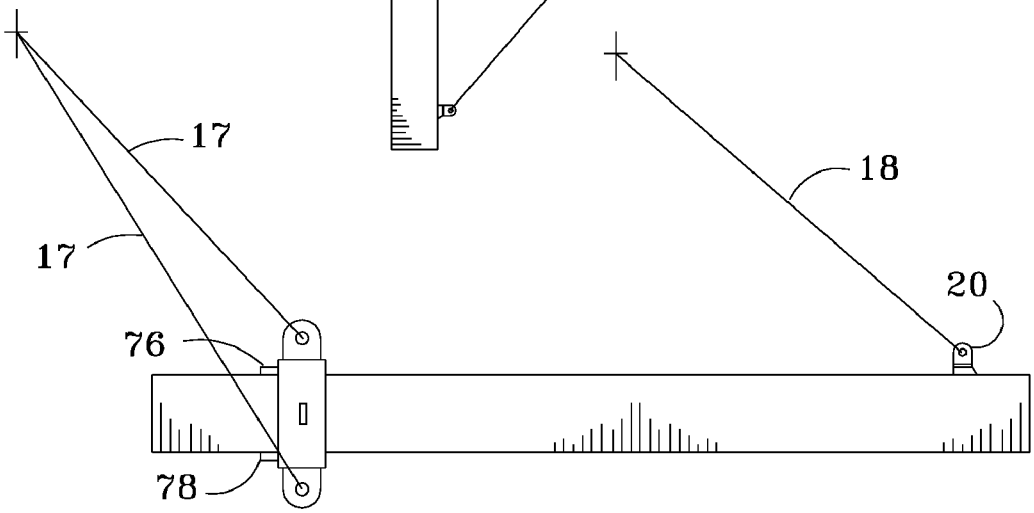

FIGS. 36 and 37 illustrate the pipe joint 11 being moved to its vertical position with the use of the lift lines 17 and the snub line 18.

Whereas the present invention has been described in particular relation to the drawings attached hereto, it should be understood that other and further modifications apart from those shown or suggested herein, may be made within the scope and spirit of the present invention.

What is claimed is:

1. An elevator for assembling a plurality of large diameter pipe joints into a pipe string with a drilling rig, a first one of the plurality of large diameter pipe joints adapted to threadingly engage a second one of the plurality of large diameter pipe joints, the elevator detachably securable to an upper end of the first joint, the elevator adapted to both lift and position the first joint while it is stabbed and tightened onto the string, and the elevator further adapted to co-operatively engage a rotary table of the drilling rig to rotatably tighten the second joint to the first joint as the second joint is added to the string wherein the elevator is secured to the first joint with a bolt on collar and the collar comprises a plurality of Keystone-shaped recesses that extend over corresponding keystone shaped projections attached to an external surface of the first pipe joint.

2. The elevator of claim 1 wherein the collar is bolted around an annular groove formed in an external surface of the first pipe joint.

3. The elevator of claim 1 wherein the elevator comprises a plurality of lifting pad eyes for attachment to lift lines on the drilling rig.

4. The elevator of claim 3 wherein at least one rotary table lug extends from one of the plurality lifting pad eyes to engage the rotary table.

5. The elevator of claim 1 wherein the collar comprises two halves, each half comprising a plurality of bolt ears adapted to receive bolts for clamping the collar.

6. The elevator of claim 2, wherein the groove in the joint is adapted to frictionally engage a complimentary, annular, centrally extending projection developed along an inner circumferential surface of the collar.

7. The elevator of claim 6, wherein the groove in the joint has a surface formed as a reverse angle shoulder adapted to engage and rest upon a similarly angled projection in the collar.

8. The elevator of claim 6, wherein as the as collar supports a weight of the string from the rotary table, a surface of a projection engaging a groove surface supports a substantial amount of the vertical load imparted to the collar by the weight of the string.

9. A drilling rig for assembling a plurality of a large diameter pipe joints into a pipe string, a first one of the plurality of large diameter pipe joints adapted to threadingly engage a second one of the plurality of large diameter pipe joints, the drilling rig comprising an elevator detachably securable to an upper end of the first joint, the elevator adapted to both lift and position the first joint while it is stabbed and tightened onto the string, and the elevator further adapted to co-operatively engage a rotary table of the drilling rig to rotatably tighten the second joint to the first joint as the second joint is added to the string wherein the elevator is secured to the first joint with a bolt on collar and the collar comprises a plurality of Keystone-shaped recesses that extend over corresponding keystone shaped projections attached to an external surface of the first pipe joint.

10. The drilling rig of claim 9 wherein the collar is bolted around an annular groove formed in an external surface of the first pipe joint.

11. The drilling rig of claim 9 wherein the elevator comprises a plurality of lifting pad eyes for attachment to lift lines on the drilling rig.

12. The drilling rig of claim 11 wherein at least one rotary table lug extends from one of the plurality of lifting pad eyes to engage the rotary table.

13. The drilling rig of claim 9 wherein the collar comprises two halves, each half comprising a plurality of bolt ears adapted to receive bolts for clamping the collar.

14. The drilling rig of claim 10, wherein the groove in the joint is adapted to frictionally engage a complimentary, annular, centrally extending projection developed along an inner circumferential surface of the collar.

15. The drilling rig of claim 14, wherein the groove in the joint has a surface formed as a reverse angle shoulder adapted to engage and rest upon a similarly angled projection in the collar.

16. The drilling rig of claim 14, wherein as the collar supports a weight of the string from the rotary table, a surface of a projection engaging a groove surface supports a substantial amount of a vertical load imparted to the collar by the weight of the string.

* * * * *